US006307525B1

(12) United States Patent
Bateman et al.

(10) Patent No.: US 6,307,525 B1
(45) Date of Patent: Oct. 23, 2001

(54) MULTIBAND FLAT PANEL ANTENNA PROVIDING AUTOMATIC ROUTING BETWEEN A PLURALITY OF ANTENNA ELEMENTS AND AN INPUT/OUTPUT PORT

(75) Inventors: Blaine Rexel Bateman, Louisville; Randy Cecil Bancroft, Denver; Robert Eugene Munson, Boulder, all of CO (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 09/789,914

(22) Filed: Feb. 21, 2001

Related U.S. Application Data

(60) Provisional application No. 60/184,990, filed on Feb. 25, 2000.

(51) Int. Cl.[7] ..... H01Q 21/00

(52) U.S. Cl. ..... 343/853; 343/858; 343/700 MS; 333/126; 455/129

(58) Field of Search ..... 343/700 MS, 850, 343/853, 852, 858, 860; 333/126, 129, 135; 455/127, 129, 103; H01Q 21/00

(56) References Cited

U.S. PATENT DOCUMENTS 4,449,128 * 5/1984 Weir ..... 343/858
4,451,832 * 5/1984 Stites ..... 343/858
4,688,259 * 8/1987 Edridge ..... 455/12
5,323,127 * 6/1994 Komazaki et al. ..... 333/126
6,055,418 * 4/2000 Harris et al. ..... 455/91
6,201,949 * 3/2001 Kich et al. ..... 455/12.1

* cited by examiner

*Primary Examiner*—Tho G. Phan
(74) *Attorney, Agent, or Firm*—F. A. Sirr; E. C. Hancock; Holland & Hart LLP

(57) ABSTRACT

A transmit/receive antenna selectively operates to transmit or receive at one or more of a plurality of different frequencies in the MHz range. A planar transmission line diplexer or multiplexer that is selected from the group microstrip multiplexer diplexer/multiplexer and stripline diplexer/multiplexer connects an input/output port to a plurality of antenna ports that are physically spaced from each other and from the input/output port. One antenna element is connected to each of the antenna ports. The transmission line diplexer/multiplexer includes a plurality of individual microstrip/stripline elements that have a characteristic impedance and a length that are selected such that the transmission line diplexer/multiplexer automatically provides a matched impedance path between a given antenna element and the input/output port when an antenna-matching frequency is received by the given antenna element or when the antenna matching frequency is applied to the input/output port. At the same time, the transmission line diplexer/multiplexer automatically provides a very mismatched impedance path between all others of the antenna elements and the input/output port.

13 Claims, 11 Drawing Sheets

```
1*************************************************
2  **MATCHING NETWORK FOR DUAL BAND MICROSPHERE**
3*****************************************************
   ****************************
6  ** LOW PASS FILTER **
7  ****************************
8
9   BLK
10  Z1:?10 14.3825 85?
11  Z2:?10 41.1473 85?
12  Z3:?40 47.5903 60?
13  Z4:?10 66.8179 85?
14  Z5:?40 58.3248 60?
15  Z6:?10 67.5141 85?
16  Z7:?40 46.4284 60?
17  Z8:?10.0 32.7685 85?
18  K1:3.21
19  L1:?0.25IN .81879IN 1.5IN?
20  L2:?0.25IN 1.39289IN 1.5IN?
21  L3:?0.25IN .853751IN 1.5IN?
22  L4:?0.25IN .9899IN 1.5IN?
23  L5:?0.25IN .250011IN 1.5IN?
24  L6:?0.25IN 1.01301IN 1.5IN?
25  L7:?0.25IN .250005IN 1.5IN?
26  L8:?0.25IN .4930571N 1.5IN?
27  TRL 1 2 Z=Z1 P=L1 K=K1
28  TRL 2 3 Z=Z2 P=L2 K=K1
29  TRL 3 4 Z=Z3 P+L3 K=K1
30  TRL 3 5 Z=Z2 P=L2 K=K1
31  TRL 5 6 Z=Z4 P=L4 K=K1
32  TRL 6 7  Z=Z5 P=L5 K=K1
33  TRL 6 8 Z=Z4 P=L4 K=K1
34  TRL 8 9 Z=Z6 P=L6 K=K1
35  TRL 9 10 Z=Z7 P=L7 K=K1
36  TRL 9 11 Z=Z6 P=L6 K=K1
    TRL  11 12 Z=Z8 P=L8 K=K1
    DIPLX:3POR 6 3 9
39 END
40
41
42*************************************************
43   ** THIS BLOCK DEFINES THE FREQUENCY SWEEP **
44 *************************************************
45 FREQ
46  ESTP 0.6GHZ 2.2GHZ 300
47  STEP 0.6GHZ 2.2GHZ 8MHZ
48 END
49
50*****************************************************
51  **THIS BLOCK IS FOR OPTIMIZING THE ARRAY MATCH**
52 *****************************************************
53 OPT
54  DIPLX
55  F=0.808GHZ .912E9
56  MS11 = .15 LT
57  MS21 = .0.05 DB LT
58  MS31 = -20 DB LT
59  F=1.78E9 2.06GHZ
60  MS11 = 0.15 LT
61  MS31 = 0.05 DB LT
62  MS21 = -20 DB LT
63  TERM = 1.0E-8
64 END
```

FIGURE 11

| | | |
|---|---|---|
| $Z_1$ = 14.38 Ω | | $L_1$ = 0.81879" |
| $Z_2$ = 41.15 Ω | | $L_2$ = 1.39289" ·2 = .78578" |
| $Z_3$ = 47.59 Ω | (STUB) | $L_3$ = 0.853751" |
| $Z_4$ = 66.81 Ω | | $L_4$ = 0.9899" ·2 = 1.9798" |
| $Z_5$ = 58.32 Ω | (STUB) | $L_5$ = 0.25" |
| $Z_6$ = 67.51 Ω | | $L_6$ = 0.01301"·2 = 2.02602" |
| $Z_7$ = 46.43 Ω | (STUB) | $L_7$ = 0.250" |
| $Z_8$ = 32.77 Ω | | $L_8$ = 0.493057 |

FIGURE 12

| | |
|---|---|
| $L_1$ = 0.741" | $W_1$ = 0.621" |
| $L_2$ = 2.840" | $W_2$ = 0.157" |
| $L_3$ = 0.765" | $W_3$= 0.126 |
| $L_4$= 2.101 | $W_4$ =0.069" |
| $L_5$ = 0.172" | $W_5$ = 0.089" |
| $L_6$ = 2.150" | $W_6$ = 0.068" |
| $L_7$ = 0.152" | $W_7$ = 0.131" |
| $L_8$ = 0.456" | $W_8$ = 0.218" |

FIGURE 13

```
1 ********************************************************
2   **MATCHING NETWORK FOR DUAL BAND MICROSPHERE EUROPEAN**
3 ********************************************************
4
5   ****************************
6  ** T LINE DIPLEXER**
7  ****************************
8
9   BLK
10  Z1:?10 63.3956 85?
11  Z2:?10 58.3282 85?
12  Z3:?35 45.3902 75?
13  Z4:?10 33.2556 85?
14  Z5:?10 84.3746 85?
15  Z6:?10 37.859 85?
16  Z7:?35 52.0274 75?
17  K1:3.21
18  L1:70.25IN .786345IN 1.5IN?
19  L2:?0.25IN  1.17687IN 2.5IN?
20  L3:?0.25IN 1.35489IN 1.5IN?
21  L4:?0.25IN .77548IN 1.5IN?
22  L5:?0.25IN 1.48651IN 1.5IN?
23  L6:?0.25IN .900181IN 1.5IN?
24  L7:?0.25IN .602111IN 1.5IN?
25  L8:?0.25IN 1.3309IN 1.5IN?
26  TRL 1 2 Z=Z1 P=L1 K=K1
27  TRL 2 3 Z=Z1 P=L2 K=K1
28  TRL 3 4 Z=Z1 P=L1 K=K1
29  TRL 3 5 Z=Z2 P=L3 K=K1
30  TRL  5 6 Z=Z2 P=L3 K=K1
31  TRL 6 7 Z=Z3 P=L4 K=K1
32  TRL 7 8 Z=Z4 P=L5 K=K1
33  TRL 7 9 Z=Z3 P=L4 K=K1
34  TRL 9 10 Z=Z5 P=L6 K=K1
35  TRL 10 11 Z=Z6 P=L7 K=K1
36  TRL 11 12 Z=Z7 P=L8 K=K1
37  TRL  11 13 Z=Z6 P=L7 K=K1
38  DIPLX:3POR 5 2 13
39 END
40
41
42*************************************************
43   ** THIS BLOCK DEFINES THE FREQUENCY SWEEP **
44*************************************************
45 FREQ
46  ESTP 0.6GHZ 2.2GHZ 300
47  STEP 0.6GHZ 2.2GHZ 8MHZ
48 END
49
50*********************************************************
51  **THIS BLOCK IS FOR OPTIMIZING THE ARRAY MATCH**
52 *********************************************************
53 OPT
54 DIPLX
55  F=0.850GHZ 1.2GHZ
56  MS11 = .15 LT
57  MS21 = 0.05 DB LT
58  MS31 = -20 DB LT
59  F=1.67GHZ  1.92GHZ
60  MS11 = 0.15 LT
61  MS31 = 0.05 DB LT
62  MS21 = -20 DB LT
63  TERM = 1.0E-8
64 END
```

FIGURE 16

| | |
|---|---|
| $L_1$ = 0.809" | $W_1$ = 0.077" |
| $L_2$ = 1.2424" | $W_1$ = 0.077" |
| $L_3$ = 2.775" | $W_2$ = 0.089" |
| $L_4$ = 1.575" | $W_3$ =0.135" |
| $L_5$ = 1.363" | $W_4$ = 0.214" |
| $L_6$ = 0.971" | $W_5$ = 0.042" |
| $L_7$ = 1.200" | $W_6$ = 0.178" |
| $L_8$ = 1.264" | $W_7$ = 0.109" |
| $Z_1$ = 63.40 | |
| $Z_2$ = 58.33 | |
| $Z_3$ = 45.39 | |
| $Z_4$ = 33.26 | |
| $Z_5$ = 84.37 | |
| $Z_6$ = 37.86 | |
| $Z_7$ = 52.03 | |

FIGURE 17

MULTIBAND FLAT PANEL ANTENNA PROVIDING AUTOMATIC ROUTING BETWEEN A PLURALITY OF ANTENNA ELEMENTS AND AN INPUT/OUTPUT PORT

CROSS-REFERENCE TO RELATED APPLICATIONS

This appln claims benefit of Prov. No. 60/184,990 filed Feb. 25, 2000.

Copending U.S. patent application Ser. No. 09/245,477 by B. R. Bateman and R. E. Munson, filed Feb. 5, 1999, and entitled FLAT PANEL ANTENNA, incorporated herein by reference.

BACKGROUND OF THE INVENTION

1. Field of the Invention

This invention relates to the field of diplexing/multiplexing flat panel antennas.

2. Description of the Related Art

The art provides small size patch and microstrip antennas that are generally useful for their limited intended purposes.

However, the need remains in the art for a small, flat, thin, multiband, high-frequency antenna that can be manufactured as a stand-alone assembly, or that can be integrated into a mobile or a fixed position wireless communication device, wherein a transmission line multiplexer, such as a microstrip diplexer/multiplexer or a stripline diplexer, functions as a frequency responsive routing network that automatically routes a given high frequency to a matching antenna element in accordance with the frequency of the high frequency.

SUMMARY OF THE INVENTION

The present invention provides a small, indoor/outdoor, shock tolerant, flat panel, multiband, diplexing/multiplexing, transmit/receive antenna.

More specifically, this invention provides a flat panel diplexing/multiplexing antenna. In diplexing embodiments of the invention a diplexing antenna is provided having a flat dielectric substrate member on one side of which is disposed a planar metal transmission line network, such as a microstrip transmission line network or a stripline transmission line network, that connects one input/output port to a first and a second antenna port. A first metal antenna element is connected to the first antenna port, and a second metal antenna is connected to the second antenna port. A continuous metal sheet is disposed on the other side of the substrate member so as to underlie only the transmission line network. The transmission line network and its overlying metal sheet form a microstrip-type diplexer that automatically provides a low-impedance-route (i.e., a matched or 50 ohm route) between the input/output port and a first antenna at one frequency, or frequency range, as the microstrip-type diplexer concomitantly provides a second high impedance route (i.e., a mismatched route) between the input/output port and the second antenna at this one frequency or frequency range. In this manner, energy at this one frequency or frequency range is automatically directed to the first antenna, as substantially none of the energy at this one frequency or frequency range is directed to the second antenna. In this same device, when a different frequency or frequency range is provided to the input/output port, energy at this different frequency or frequency range is automatically directed to the second antenna, as substantially none of the energy at this different frequency or frequency range is directed to the first antenna.

Thus, the diplexing/multiplexing antenna of the invention operates at the one frequency or frequency range, at the different frequency or frequency range, or at both the one frequency or frequency range and the different frequency or frequency range, all without physical switching being required.

In a preferred embodiment of an antenna in accordance with this invention, a unitary construction is formed on a flat and planar copper clad and low loss dielectric substrate; for example, a substrate that is made from a phenolic resin.

The substrate is quite thin and is generally rectangular, or perhaps square, in its top and bottom profile views. The substrate includes a first flat side, a second flat side that is generally parallel to the first flat side, and four edge portions that form the four rectangular, or square boarders or edges of the substrate.

An input/output port or terminal is provided on an edge of the substrate, or by means of a connection directly to the input/output port of the diplexer/multiplexer antenna.

In one embodiment of the invention, at least two physically spaced antenna ports are also provided on the edges of the substrate. In this embodiment of the invention, an antenna element is cable-connected to each of the antenna ports.

In another embodiment of the invention, at least two antenna ports are located on the one side of the substrate so as to be spaced from the substrate edges. In this embodiment of the invention triangular shaped, or pseudo triangular shaped, metal or copper antenna elements, each having an apex and a base, are also located on this one side of the substrate, and the triangle apex of each antenna element is formed integrally with a metal antenna port.

A metal or copper transmission line conductor pattern, such as a microstrip conductor pattern or a stripline conductor pattern, is also located on this one side of the substrate to form a transmission line network that connects each of the antenna ports to the input/output port. In an embodiment of the invention, the input/output port was a 50 ohm port.

The transmission line diplexer/multiplexer construction and arrangement is defined by a metal conductor pattern that lies on this one side of the substrate.

When the transmission line diplexer/multiplexer is a microstrip diplexer/multiplexer, a metal sheet on the other side of the substrate is provided to underlie only the metal conductor pattern, and one conductor of a feed line is connected to the input/output port as the other conductor of the feed line is connected to the metal sheet.

When the transmission line diplexer/multiplexer is a stripline diplexer/multiplexer, a second metal sheet is provided to be insulated from and to overlie only the metal conductor pattern. In this diplexer/multiplexer, the second metal sheet is electrically connected to the first metal sheet.

The transmission line diplexer/multiplexer operates such that when a given high or MHz frequency (such as 860 MHz having utility in cellular analog local telephone service) is applied to the input/output port, a matched or 50 ohm impedance path exists between the input/output port and a first antenna port, whereas the impedance path that the transmission line diplexer/multiplexer presents relative to all other antenna ports is mismatched and so far from 50 ohms that all other antenna ports are isolated from the given high or MHz frequency input energy. When a different-frequency is applied to the input/output port, a matched or 50 ohm impedance path exists between the input/output port and a different antenna port, whereas the impedance path that the transmission line diplexer/multiplexer now presents relative to all other antenna ports is mismatched and so far from 50 ohms that all other antenna ports are isolated from the different-frequency input energy.

Each individual metal conductor that is within the transmission line diplexer/multiplexer provides an individual microstrip or stripline conductor. The characteristic impedance and the length of each individual microstrip/stripline conductor is selected to provide the low impedance path to the correct antenna port.

The characteristic impedance of any given microstrip/stripline conductor is a function of (1) the width of the microstrip/stripline conductor (i.e., the dimension that is measured parallel to the underlying substrate surface), and (2) the thickness of the substrate (i.e., the dimension that is measured perpendicular to the underlying substrate surface), with the thickness of the given microstrip/stripline conductor and the thickness of the metal sheet (also called a ground plane) that underlies/overlies the microstrip/stripline conductor element having only a minor affect on the characteristic impedance of the given microstrip/stripline conductor.

A two wire connector, a two wire cable, or a coaxial cable having a metal ground connection or metal sheath and a metal feed conductor is provided. The ground connection is electrically connected to the metal sheet(s) that underlies/overlie the transmission line conductor pattern, whereas the feed conductor is connected to the input/output port.

As a feature of the invention, but without limitation thereto, a method of the invention provides an antenna as above described wherein a thin and planar dielectric substrate member is first formed such that its two parallel and opposing sides are full surface coated with a thin layer or film of copper. The two opposing sides of the substrate member are then processed using known copper-removal techniques in order to form the microstrip/stripline conductor pattern on one side of the substrate member, and to form the underlying metal sheet on the opposite side of the substrate member. In addition, the antenna elements can be formed integrally with the microstrip/stripline conductor pattern on the one side of the substrate member. In this arrangement, the layered structure that comprises the metal microstrip/stripline conductor pattern, the dielectric substrate member, and the underlying metal sheet provide a microstrip diplexer/multiplexer. When a second substrate member and its overlying metal sheet are provided, a stripline diplexer/multiplexer in accordance with the invention is provided.

Antennas in accordance with this invention find utility when installed directly into end use system applications where the antenna is used in its as-is form, with its feed cable connected to one or more other devices. An example of such an end use application is a device having a low noise receiver amplifier (LNA), a high power transmitter amplifier (HPA), and a switch for selectively connecting one of the two amplifiers to the antenna feed cable and then to the antenna feed line.

Generally, antennas in accordance with this invention find utility when integrated into higher level products, such as mobile cellular telephones, wireless laptop computers and GPS devices for automobiles, when integrated into fixed position devices having a wireless communication capability, such as personal computers that are connected in a Wireless Local Area Network (WLAN), or when integrated into hand-held devices and fixed position devices where wireless communication is a factor in device utilization.

An additional utility of antennas in accordance with the invention is in multi-antenna systems that select a given radiating element for use based upon factors such as the signal strength being received by each of the system physically spaced radiating elements. In this utility of the invention, it is within the spirit and scope of this invention to use a dielectric circuit board of a higher level product as the substrate of this invention unitary antenna.

Due to the small size and weight of antennas in accordance the invention, the antennas can be used in many applications where conventional patch antennas are not suitable.

Without limitation thereto, the antennas described relative to embodiments of this invention are intended to operate in the diplexer frequencies 860–986 MHz and 1850–1990 MHz, 880–960 MHz, and in the diplexer frequency 1795 MHz.

In an embodiment of the invention, a flat panel antenna is made from a copper clad (i.e., metal clad) laminate (flammability class V-0) having a nominal thickness of about 0.0566-inch, with copper about 0.0014-inch thick being used for the metal sheet, the antennas, and the microstrip/stripline conductor pattern.

In an embodiment of the invention, the antenna is seal-coated with a non-flammable, low VOC, water based, acrylic coating, thus providing an esthetically pleasing antenna, and an antenna that does not require a radome, although the antennas in accordance with the invention are operable with a radome, if desired.

Cable routing that is disclosed relative to embodiments of this invention either extends generally parallel to a flat plane that is occupied by the antenna, or extends generally perpendicular to the flat plane that is occupied by the antenna. However, other cable routings are considered to be within the spirit and scope of this invention.

The present invention provides a single input/output, flat panel, diplexing/multiplexing, microstrip/stripline, diplexing/multiplexing, antenna that operates in the MHz to GHz frequency range, the antenna having a transmission line diplexer/multiplexer that is formed in a single process step, such as by copper-etching, to provide nearly complete isolation between a number of antenna output ports and MHz/GHz transmit/receive frequencies that are of interest.

Low insertion loss is provided at each of the MHz/GHz frequencies that are applied to the antenna single input/output port and then to the antenna ports, wherein the output port is diplexer/multiplexer-connected to a number of different antennas, each individual antenna being constructed and arranged to operate at one of a number of different MHz frequencies. At the same time, nominal 50 ohm impedance matching is provided at the input/output port for all of the MHz/GHz frequencies that are serviced by the plurality of antennas.

Each antenna, along with its transmission line diplexer/multiplexer in accordance with this invention, has a minimum number of parts, and operation of the transmission line diplexer/multiplexer is optimized for a desired number of high or MHz/GHz frequencies.

The flat panel geometric configuration of the antenna can be either linear, bent or folded, and the geometric configuration can be adapted to accommodate a large number of antenna configurations on its antenna ports, depending upon the application being served. For example, direct connections can be made to microstrip or similar antenna elements.

Feeding the antenna can be by way of microstrip or stripline edge launching from a conventional or a panel mount type, or it can be by way of a coaxial cable or from a coaxial connector.

In an embodiment of the invention, a folded geometry, panel mount feed antenna is provided wherein one 50 ohm antenna port is directly connected to an 860 MHz broadband cellular radiating element, and wherein a second 50 ohm antenna port is directly connected to a 1920 MHz broadband and PCS radiating element, thereby providing a true dual-band antenna that is capable of operating at these two MHz frequencies without significant losses occurring relative to either radiating element, and with good impedance matching being provided at a single 50 ohm input/output or feed port.

In another embodiment the invention, services 920 and 1795 MHz.

As a feature of the invention, a coaxial cable feed is connected to the input/output port, the coaxial cable extending either perpendicular to, or parallel to, the substrate metal sheet, the parallel configuration allowing the antenna to be used in mobile applications such as vehicles where flat geometry and parallel coaxial cable routing offer advantages such as "stealth".

As an additional feature, and when a "cable on board" termination is used to terminate the coaxial cable at the input/output port, a coaxial cable leaves the antenna as it extends generally perpendicular to the substrate's metal sheet. In this way, a wide variety of connectors can be used on the remote end of the coaxial cable without disrupting the antenna fields, such as might occur if a well-known type N panel connector were directly connected to the input port.

In an embodiment of the invention, the antenna comprises copper conductor elements and a copper sheet element on opposite sides of a flat phenolic board, and the antenna is coated or covered by a protective acrylic coating, thus eliminating the need for a radome enclosure for the antenna, this acrylic coating being applied at a thickness, or a range of thickness to ensure that the antenna's frequency response is not affected, a preferred thickness being in the range of from about 0.005 to about 0.007-inch, such a thickness range providing a pleasing cosmetic appearance without the occurrence of undue losses or frequency shifting, and the thickness range being applied by a controlled manufacturing process that ensures the uniform mass production of antennas in accordance with the invention.

As a feature of the invention, mounting holes are provided in the antenna flat substrate board, such that the antenna can be physically attached to a wide variety of surfaces (for example, drop-ceiling tile found on the inside of buildings), such mounting providing good antenna performance, while at the same time achieving a minimum visual impact.

These and other features and advantages of the present invention will be apparent to those of skill in the art upon reference to the following detailed description, which description makes reference to the drawing.

BRIEF DESCRIPTION OF THE DRAWING

FIGS. 9–17 disclose other aspects of the invention.

DESCRIPTION OF THE PREFERRED EMBODIMENT(S)

Figure 1:
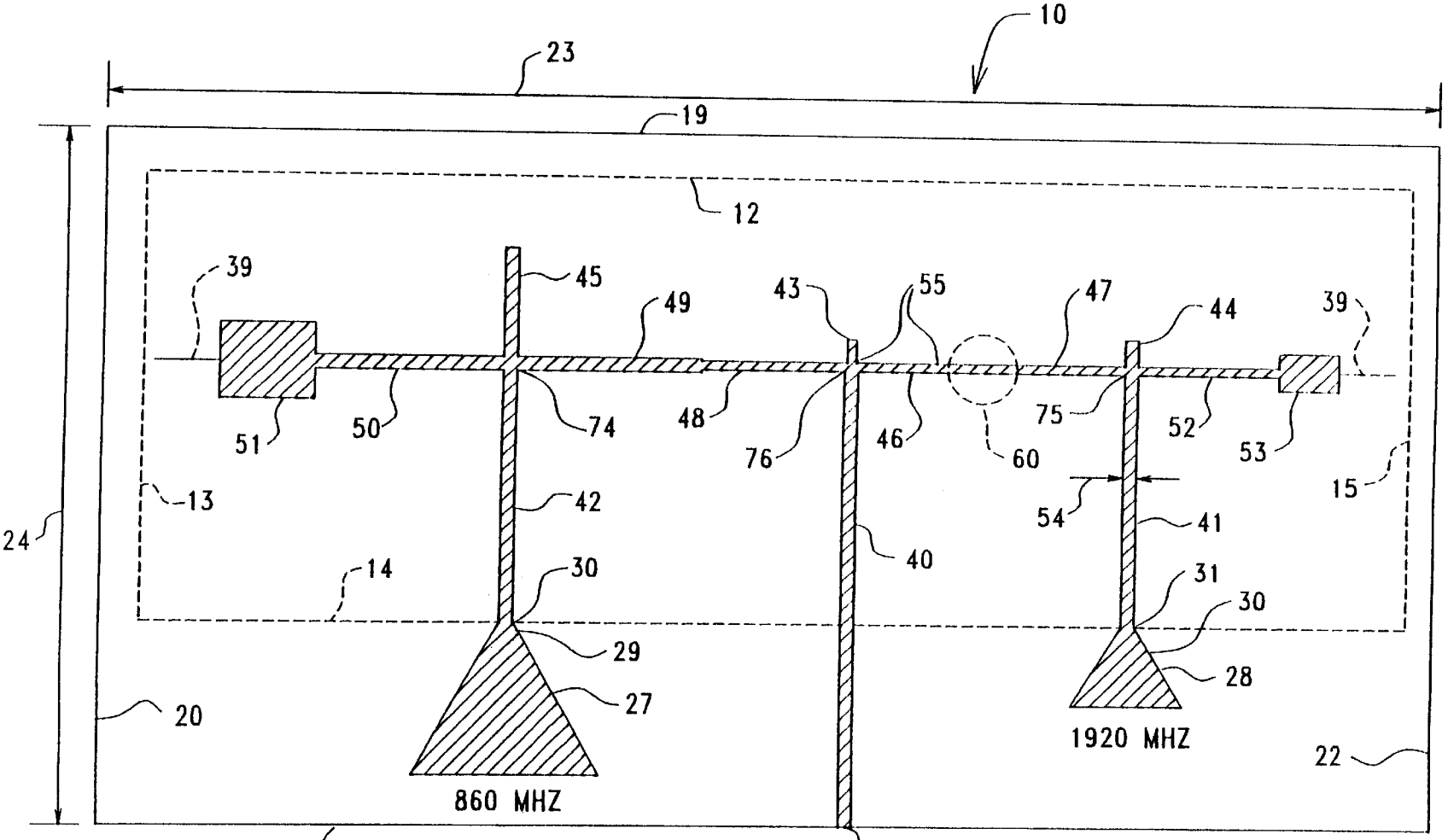
FIG. 1 is a top view of a high frequency diplexing (860/1920 MHz) antenna in accordance with the invention, this figure showing the antenna two metal antenna elements, this figure showing a metal microstrip/stripline conductor pattern that forms a transmission line diplexer that connects a single input/output port to two antenna ports and then to the two metal antenna elements that are formed integrally with the conductor pattern, and this figure showing that the antenna single input/output port extends to an edge of the antenna's substrate member to thereby provide that the antenna is edge-feed by a 50 ohm cable or cable connector that extends generally parallel to the plane of the substrate member.
Figure 2:
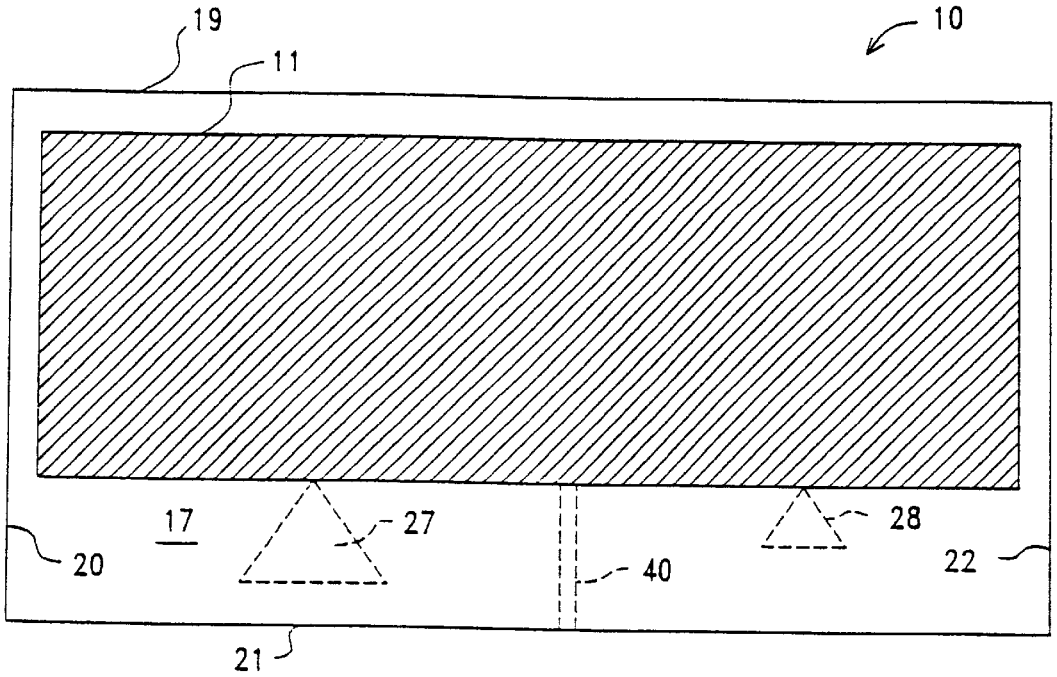
FIG. 2 is a bottom view of the antenna of FIG. 1, this figure showing the continuous metal sheet that underlies only FIG. 1 conductor pattern, and acts as one member of the transmission line diplexer.
Figure 3:
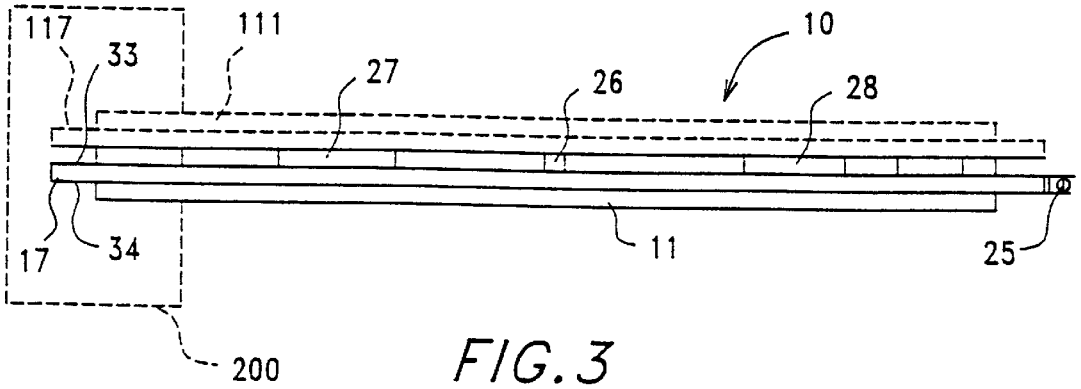
FIG. 3 is a side view of the antenna of FIG. 1, this figure better showing the thin, rigid and dielectric substrate member, and this figure also showing by way of dotted line how a second substrate member and a second continuous metal sheet may overlie FIG. 1 conductor pattern to thereby form a stripline structure.

FIGS. 1–3 show a first embodiment of an antenna 10 in accordance with the invention, FIG. 1 being a top view, FIG. 2 being a bottom view, and FIG. 3 being a side view.

This embodiment of the invention provides a flat panel diplexing antenna 10 that is operable to transmit/receive electromagnetic energy at a relatively lower MHz frequency of about 860 MHz and/or at a relatively higher MHz frequency of about 1920 MHz. While FIG. 1 is characterized as a top view of antenna 10, it should be noted that antenna 10 will operation in any physical attitude.

Reference numeral 17 designates the antenna thin, planar, rigid, generally rectangular, and dielectric substrate member having four side edges 19–22, a top surface 33 and a bottom surface 34. Top and bottom surfaces 33, 34 are mutually parallel surfaces, as is best seen in the side view of FIG. 3. Without limitation thereto, substrate 17 is formed of a dielectric plastic (for example, a phenolic resin, substrate 17 being about 9.5-inches long as shown by dimension 23), substrate 17 being about 5.0-inches wide as shown by dimension 24 and substrate 17 being about 0.0566-inches thick as shown by dimension 25.

As will be explained, thickness dimension 25 of substrate 17 determines, in part, the transmission line characteristic impedance of the individual conductors that are within a pattern 35 of metal microstrip conductors that are located on the top surface 33 of substrate 17.

A fundamental way in which to view conductor pattern 35 is to consider each individual conductor element and its characteristic impedance and length, as is found in the following Tables. Consideration of a conductor's characteristic impedance and length is equivalent to considering the conductor length, its width, and its thickness, and the dielectric constant of the substrate that carries the conductor. In an embodiment of the invention, a numerical optimization computer program was used to generate each conductor characteristic impedance and length, subject to physical constraints that were placed on the computer optimization relative to a particular physical design that was desired.

In the transmit mode of operation of antenna 10, when energy of the lower MHz frequency of 860 MHz is applied to input/output port 26, this lower MHz frequency energy is radiated from a metal or cooper first radiating element 27, when energy of the higher MHz frequency of 1920 MHz is applied to input/output port 26 this higher MHz frequency energy is radiated from a metal or copper second radiating element 28, and when energy having both the lower MHz frequency constituent and the higher frequency constituent is applied to input/output port 26, the lower frequency constituent is radiated from first radiating element 27, and the higher frequency constituent is concomitantly radiated from second radiating element 28.

In a receiving mode of operation of antenna 10, automatic frequency routing also occurs also between antenna elements 27 and 28 and input/output port 26 as above described.

Antenna receiving/transmitting elements 27, 28 are both located on the top surface 33 of substrate member 17. Thus, the two antenna elements 27, 28 reside in a common flat plane 33 that is formed by the top flat surface 33 of substrate member 17.

Without limitation thereto, antenna elements 27, 28 are patch elements that are both shaped as planar triangles, with apex 29 of antenna element 27 being integrally formed with a metal or copper first antenna port 30, and with apex 30 of antenna element 28 being integrally formed with a metal or copper second antenna port 31.

FIG. 2 best shows a continuous metal or copper, flat, and generally rectangular shaped sheet element that underlies conductor pattern 35 and forms a portion of diplexer 35, this diplexer also including substrate member 17 and the metal conductor pattern. Sheet element 11 resides in a flat plane that is formed by the bottom flat surface 34 of substrate member 17. As stated above, the top and bottom surfaces 34, 34 of substrate member 17 are mutually parallel, thus sheet element 11 is parallel to antenna elements 27 and 28 and to conductor pattern 35. As shown by dotted line 11 in FIG. 1, sheet element 11 does not underlie either of the two antenna elements 27, 28.

As best shown in FIG. 1, sheet element 11 defines a central area 16 of antenna 10, this central area 16 having the four side edges 12–15. Without limitation thereto, FIG. 1 shows that the antenna input/output port 26 extends to the side edge 21 of the antenna substrate member 17, to thereby provide that antenna 10 is edge fed by a cable or a cable connector (not shown) that extends generally parallel to the plane of substrate member 17. It is to be noted however that the input/output feed for antenna 10 can be provided at any desired point along the length of transmission line 40, whereupon transmission line 40 can be shortened to extend only to the point of the input/output feed connection.

In accordance with the invention, FIG. 1 shows that transmission line conductor pattern 35 that resides entirely within central area 16, and that conductor pattern 35 operates with metal sheet 11 and dielectric substrate 17 to form a diplexer network that electrically interconnects input/output port 26, the two antenna ports 30 and 31, and the two metal antenna elements 27, 28.

While FIGS. 1–3 show this embodiment of the invention to include a microstrip-type of diplexer 35, it is within the spirit and scope of the invention to provide a stripline-type of diplexer 35, in which case a second substrate member 117 and a second continuous metal (copper) sheet member 111 are provided as shown by dotted lines in FIG. 3 to overlie conductor pattern 35. In this stripline embodiment of the invention, second substrate member 117 need overlie only conductor pattern 35, and second metal sheet member 111 is a continuous member that overlies only conductor pattern 35 in the same manner as first metal sheet member 11 underlies only conductor pattern 35. Metal sheet members 11 and 111 are electrically connected as shown by dotted line 200 in FIG. 3.

In accordance with the invention, conductor pattern 35 is dimensioned or sized such that the diplexer that is formed by conductor pattern 35 in conjunction with substrate member 17 and metal sheet 11 (and perhaps metal sheet 111) provides (1) a matched characteristic impedance (50 ohm) path between input/output port 26 and antenna element 27 relative to the lower MHz frequency energy, while at the same time providing an isolating-type mismatched characteristic impedance path between input/output port 26 and antenna element 28, and provides (2) a matched characteristic impedance (50 ohm) path between input port 26 and antenna element 28 relative to the higher MHz frequency energy, while at the same time providing an isolating-type mismatched characteristic impedance path between input/output port 26 and antenna element 27.

As used herein, the term "characteristic impedance" means the real-number impedance that would be simulated by a given two-conductor line of uniform construction if that line were of infinite length. That is, the characteristic impedance has essentially no imaginary portion. In the construction and arrangement of this invention, the characteristic impedance of a given microstrip conductor element is determined by the material that is used to make the metal microstrip conductor element, by the material that is used to make metal sheet 11 (and perhaps metal sheet 111), by the dielectric constant of substrate member 17 (and perhaps substrate 117) that is used to insulate the given metal microstrip conductor element from the metal sheet(s), by the physical spacing of the given metal microstrip conductor element from the metal sheet(s) i.e., by the thickness of substrate member(s), and by the width of the conductor element.

Figure 7:
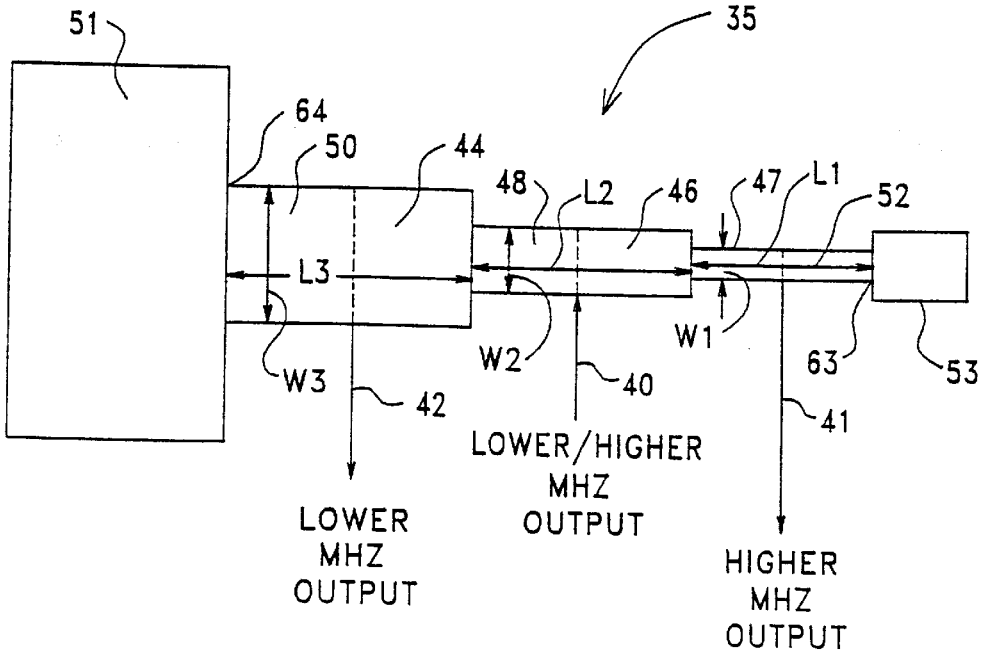
FIG. 7 provides a more general teaching of the present invention, this figure being representative of both the FIG. 1 linear embodiment of the invention and the FIG. 5 bent embodiment of the invention.

With reference to FIGS. 1 and 7, and with reference to a non-limiting example wherein antenna 10 operates as a diplexing antenna at the two relatively high frequencies of 860 MHz and 1920 MHz, diplexer 35 is constructed and arrange to provide an input/output microstrip transmission line element 40 whose characteristic impedance is 50 ohms, a first-antenna microstrip transmission line 41 whose characteristic impedance is 50 ohms, and a second-antenna microstrip transmission line element 42 whose characteristic impedance is 50 ohms. In this embodiment of the invention, microstrip transmission line elements 40, 41 and 42 are mutually parallel.

A first microstrip transmission line tuning stub element 43 forms a linear extension of input/output conductor element 40, the characteristic impedance of tuning stub element 43 being 58.32 ohms, a second microstrip transmission line tuning stub element 44 forms a linear extension of antenna conductor element 41, the characteristic impedance of tuning stub element 44 being 46.43 ohms, and a third microstrip transmission line tuning stub element 45 forms a linear extension of antenna conductor element 42, the characteristic impedance of tuning stub element 45 being 47.59 ohms.

Two series-connected microstrip transmission line elements 46 and 47 connect input/output microstrip transmission line element 40 to antenna microstrip transmission line element 41. Microstrip transmission line element 46 is only slightly wider than microstrip transmission line element 47, with the characteristic impedance of microstrip transmission line element 46 being 66.81 ohms and with the characteristic impedance of microstrip transmission line element 47 being 67.51 ohms.

Two series-connected microstrip transmission line elements 48 and 49 connect input/output microstrip transmission line element 40 to antenna microstrip transmission line element 42. Microstrip transmission line element 49 is relatively wide as compared to microstrip transmission line element 48, with the characteristic impedance of microstrip transmission line element 48 being 66.81 ohms and with the characteristic impedance of microstrip transmission line element 49 being 41.15 ohms.

A two width microstrip transmission line tuning stub 50, 51 forms a linear extension of microstrip transmission line element 49, with the characteristic impedance of relatively narrower tuning stub 50 being 41.15 ohms, and with the characteristic impedance of relatively wider tuning stub 51 being 14.38 ohms.

Diplexer 35 is completed by a two-width microstrip transmission line tuning stub 52, 53 that forms a linear extension of microstrip transmission line element 47, with the characteristic impedance of relatively narrower tuning stub element 52 being 67.51 ohms, and with the characteristic impedance of relatively wider tuning stub element 53 being 32.77 ohms.

In this embodiment, all of the elements 46–53 are centrally aligned along an axis 39 that intersects the central axes of elements 40–42 at right angles.

The following Table 1 provides the above characteristic impedance values in the form of a table.

TABLE 1

| | |
|---|---|
| Microstrip element 40 | 50.00 ohms |
| Microstrip element 41 | 50.00 ohms |
| Microstrip element 42 | 50.00 ohms |
| Microstrip element 43 | 58.32 ohms |
| Microstrip element 44 | 46.43 ohms |
| Microstrip element 45 | 47.58 ohms |
| Microstrip element 46 | 66.81 ohms |
| Microstrip element 47 | 67.51 ohms |
| Microstrip element 48 | 66.81 ohms |
| Microstrip element 49 | 41.15 ohms |
| Microstrip element 50 | 41.15 ohms |
| Microstrip element 51 | 14.38 ohms |
| Microstrip element 52 | 67.51 ohms |
| Microstrip element 53 | 32.77 ohms |

The following Table-2 shows the widths of the above described microstrip transmission line elements (i.e., the short dimension of a microstrip transmission line element as measured parallel to the top surface 33 of substrate 17 (for example, see the width 54 of microstrip transmission line element 41) and the lengths of the above described microstrip transmission line elements (i.e., the long dimension of a microstrip transmission line element as measured parallel to the top surface 33 of substrate 17 (for example, see the length 55 of microstrip transmission line element 46).

TABLE 2

| | Width | Length |
|---|---|---|
| Microstrip element 40 | 0.1160 inch | As desired |
| Microstrip element 41 | 0.1160 inch | As desired |
| Microstrip element 42 | 0.1160 inch | As desired |
| Microstrip element 43 | 0.0890 inch | 0.1720 inch |
| Microstrip element 44 | 0.1307 inch | 0.1520 inch |
| Microstrip element 45 | 0.1257 inch | 0.8540 inch |
| Microstrip element 46 | 0.0690 inch | 1.0500 inch |
| Microstrip element 47 | 0.0678 inch | 1.0130 inch |
| Microstrip element 48 | 0.0690 inch | 1.0505 inch |
| Microstrip element 49 | 0.1573 inch | 1.4200 inch |
| Microstrip element 50 | 0.1573 inch | 1.4200 inch |
| Microstrip element 51 | 0.6210 inch | 0.7410 inch |
| Microstrip element 52 | 0.0678 inch | 1.0130 inch |
| Microstrip e1ement 53 | 0.2184 inch | 0.4560 inch |

From above Table 2 it can be seen that the length of the input/output and antenna microstrip elements is not critical to the invention.

From above Table 2 it can be seen that input/output microstrip element 40 right angle joins composite microstrip element 46, 48 at its midpoint, i.e., the microstrip elements 46 and 48 are both 0.690-inch wide and 1.0505-inch long. It can also be seen that 1920 MHz antenna microstrip element 41 right-angle joins composite microstrip element 47, 52 at its midpoint, i.e. microstrip elements 47 and 52 are both 0.0678-inch wide and 1.0130-inch long. It can also be seen that 860 MHz antenna microstrip element 42 right-angle joins composite microstrip element 49, 50 at its midpoint, i.e., microstrip elements 49 and 50 are both 0.1573-inch wide and 1.420-inch long.

Another electrical property of the various microstrip conductor elements that make up diplexer 35 is the effective dielectric constant of each microstrip conductor element. The following Table 3 lists these effective dielectric constants, and repeats the width of the various microstrip conductor elements to show that the effective dielectric constant varies a direct function of the width of a microstrip conductor element. That is, the wider the microstrip conductor element, the higher is its effective dielectric constant.

TABLE 3

| | Width | Effective Dielectric Constant |
|---|---|---|
| Microstrip element 40 | 0.1160 inch | 2.98 |
| Microstrip element 41 | 0.1160 inch | 2.98 |
| Microstrip element 42 | 0.1160 inch | 2.98 |
| Microstrip element 43 | 0.0890 inch | 2.91 |
| Microstrip element 44 | 0.1307 inch | 3.01 |
| Microstrip element 45 | 0.1257 inch | 3.00 |
| Microstrip element 46 | 0.0690 inch | 2.85+ |
| Microstrip element 47 | 0.0678 inch | 2.85 |
| Microstrip element 48 | 0.0690 inch | 2.85+ |
| Microstrip element 49 | 0.1573 inch | 3.06 |
| Microstrip element 50 | 0.1573 inch | 3.06 |
| Microstrip element 51 | 0.6210 inch | 3.48 |
| Microstrip element 52 | 0.0678 inch | 2.85 |
| Microstrip element 53 | 0.2184 inch | 3.16 |

Note from above Table 3 that the effective dielectric constants of microstrip conductor elements 46 and 48 (effective dielectric constant of 2.85+ and a width of 0.0690-inch) are only slightly larger than the dielectric constants of microstrip conductor elements 47 and 52 (effective dielectric constant of 2.85 and a width of 0.0678-inch).

Another electrical property of the various microstrip conductor elements that make up diplexer 35 is the dB loss per inch length of each microstrip conductor element. The following Table 4 lists these dB/inch losses.

TABLE 4

| | dB loss/inch |
|---|---|
| Microstrip element 40 | 0.01387 |
| Microstrip element 41 | 0.01397 |
| Microstrip element 42 | 0.01387 |
| Microstrip element 43 | 0.01428 |
| Microstrip element 44 | 0.01372 |
| Microstrip element 45 | 0.01377 |
| Microstrip element 46 | 0.01479 |
| Microstrip element 47 | 0.01484 |
| Microstrip element 48 | 0.01479 |
| Microstrip element 49 | 0.01352 |
| Microstrip element 50 | 0.01352 |
| Microstrip element 51 | 0.01315 |
| Microstrip element 52 | 0.01484 |
| Microstrip element 53 | 0.01326 |

In this embodiment of the invention, the thickness of all metal microstrip conductor elements 40–52 (i.e., the dimension of a conductor element measured perpendicular to the top surface 33 of substrate 17) was the same, and this thickness was 0.0014-inches.

In this embodiment, the thickness 25 of substrate 17 was 0.0566-inch, and the dielectric constant of substrate 17 was 3.9.

Figure 4:
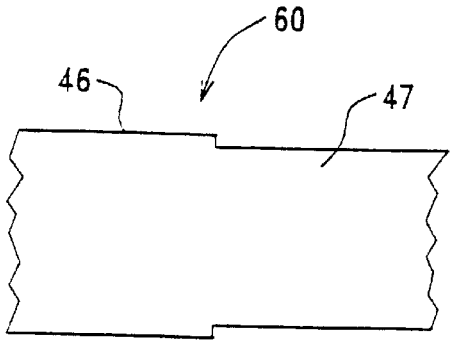
FIG. 4 is a greatly enlarged showing of a portion of two of the conductor elements of FIG. 1, FIG. 4 better showing that this portion includes two conductor elements that are of slightly different widths.

FIG. 4 is a greatly enlarged showing of the portion 60 of diplexer 35 that is shown in FIG. 1. FIG. 4 better shows that microstrip conductor element 46 is wider than microstrip conductor element 47, as is also indicated in above Table 2.

Figure 5:
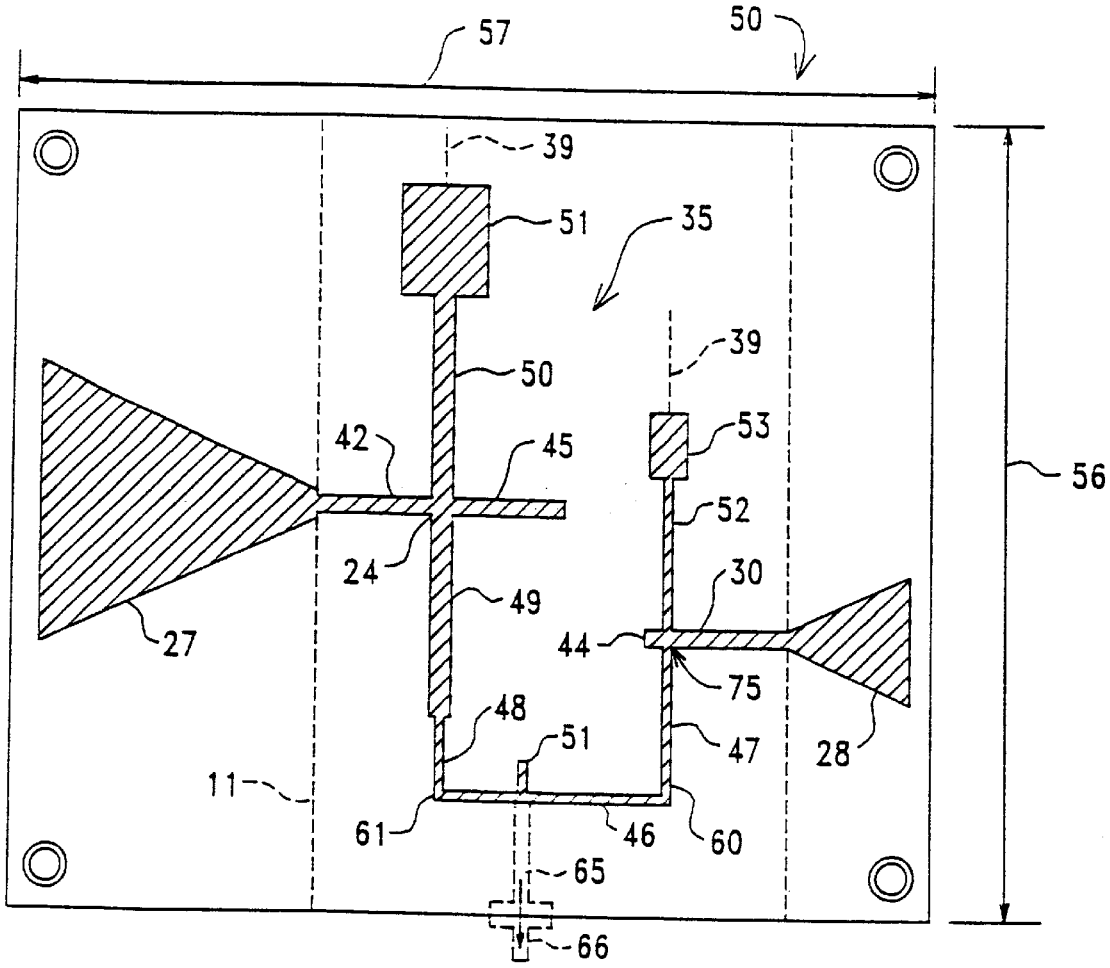
FIG. 5 is a top view that is similar to FIG. 1 wherein the conductor pattern of FIG. 1 has been folded or bent so that the two metal antenna elements are located at opposite sides of the assembly, and this figure showing that the assembly's single input/output port may reside within the confines of an area that is defined by the substrate's continuous metal sheet so that the assembly of FIG. 5 is feed by a feed cable, or feed connector that extends generally perpendicular to the plane of the substrate.
Figure 6:
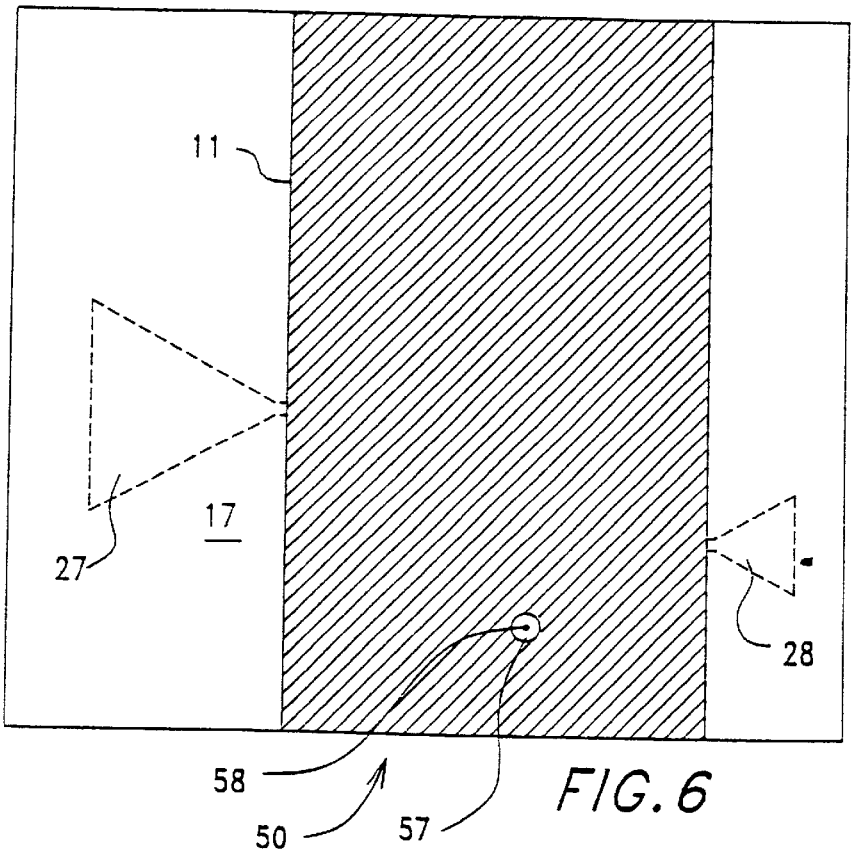
FIG. 6 is a bottom view of the assembly of FIG. 5, this bottom view showing the continuous metal sheet the underlies only the diplexer conductor pattern, and this figure also showing a through hole by which electrical connection is made to the single input/output port, the side view of the antenna of FIG. 5 being somewhat shorter than, but generally similar to FIG. 3, including a second continuous metal sheet that overlies only the diplexer conductor pattern.

FIGS. 5 and 6 provide views that are similar to FIGS. 1 and 2 wherein a diplexing antenna 50 as described relative to FIGS. 1–3 has been folded or bent to form two 90-degree turns 60 and 61 in axis 39. Thus, in this embodiment, the two integral metal antenna elements 27 and 28 are located at opposite sides of antenna 50, rather than on the same side as shown in FIG. 1.

FIG. 5 shows that the antenna's single input/output port 51 resides within the confines of continuous metal sheet element 11, such that antenna 51 is fed by a cable or by a cable connector (not shown) that extends generally perpendicular to the plane of the antenna substrate member 17.

FIG. 6 is a bottom view of antenna 50, and this bottom view best shows the antenna generally rectangular metal sheet element 11, this figure also showing a hole 57 that is formed in sheet element 11 directly under input/output port 51, hole 57 providing a means by which an electrical connection is made to the antenna single input/output port 51. In this configuration, a coaxial cable outer metal sheath can be soldered to sheet member 11 (and a second sheet member 111 is connected to sheet member 11 as shown in FIG. 3, when such a second sheet member 111 is provided to form a stripline structure) in the area that is immediately adjacent to hole 57, whereas the coaxial cable centrally-located conductor penetrates relatively large hole 57 in sheet element 11, penetrates a smaller hole 58 that is centrally located in hole 57 and is formed in substrate member 17, penetrates a similarly sized and aligned small hole 58 that is formed in input port 51, and is then soldered to input/output port 51.

The dotted lines of FIG. 5 show a variation of antenna 50, whereby an externally threaded coaxial connector 66 may be mounted on the edge of the antenna substrate member 17, with the connector external metal body being connected to sheet element 11 (and to second sheet member 111), and with the connector centrally-located conductor or pin extending parallel to the sheet element and being connected to a microstrip transmission line element 65 that is aligned to be an extension of microstrip transmission line element 51.

The side view of antenna 50 (not shown) is somewhat shorter than, but is generally similar to the side view of antenna 10, as seen in FIG. 3.

In a non-limiting embodiment of antenna 50, the antenna has a width dimension 56 of about 5.340-inch, and had a length dimension 57 of about 6.264-inch. The microstrip pattern 35 of this embodiment of antenna 50 was as above described. Thus, the corresponding microstrip conductor element reference numerals are repeated in FIG. 5.

Figure 8:
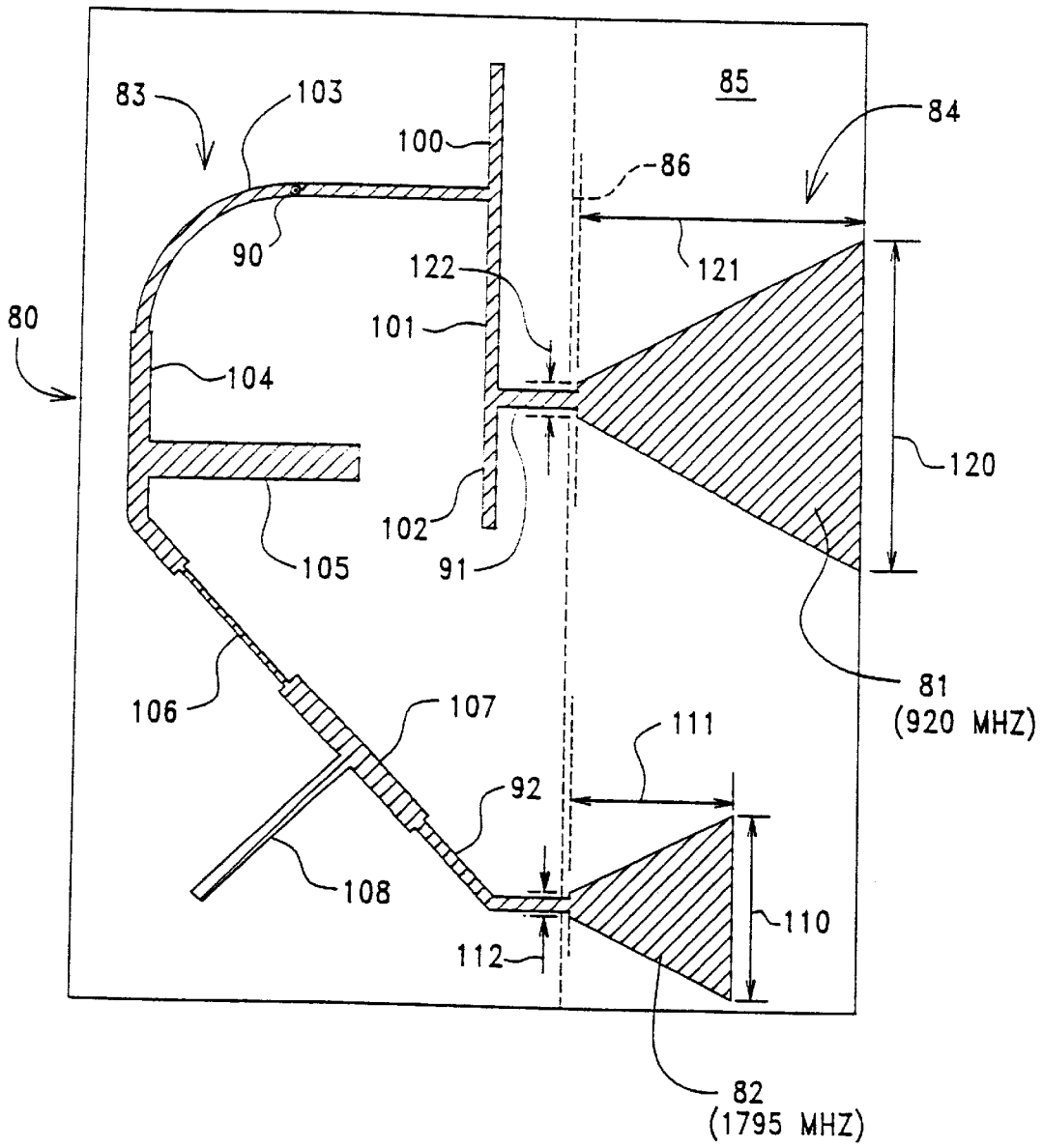
FIG. 8 shows another embodiment of a high frequency diplexing (920/1795 MHz) antenna in accordance with the invention having and having two metal antenna elements that are formed integrally with the transmission line diplexer metal conductor pattern.

FIG. 8 is a top view of another embodiment of a high frequency (920/1795 MHz) diplexing antenna 80 in accordance with the invention. While a bent conductor configuration is shown in FIG. 8, it is within the spirit and scope of the invention to provide a linear version of antenna 80, as shown in FIG. 1.

Antenna 80 includes a 920 MHz metal (copper) antenna element 81 and a 1795 MHz metal (copper) antenna element 82, both of which are formed integrally with a metal pattern 83 that forms a transmission line diplexer 83 in accordance with the invention.

As with previously described embodiments of the invention, antenna 80 includes a thin and flat dielectric substrate member 84 whose top planar surface 85 carries conductor pattern 83 and antenna elements 81, 81 as a one metal piece pattern that is formed on top surface 85 by selective metal (copper) removal techniques.

Dotted line 86 shows the edge of a continuous bottom-located metal (copper) sheet that is carried by the bottom planar surface of substrate 84, and this bottom metal sheet underling only conductor pattern 83 in the same manner as was above described relative to FIGS. 1 and 5, to thus form a microstrip type of diplexer that comprises the bottom metal sheet, substrate 84 and metal conductor pattern 83.

While not shown in FIG. 8, a second thin and flat substrate member and its second continuous metal sheet may be provided for antenna 80 to overlie conductor pattern 83, and to thus provide a stripline type of diplexer that comprises the bottom metal sheet, substrate member 84, metal conductor pattern 83, the second substrate member, and the top metal sheet, as was described above relative to FIGS. 1 and 5.

Substrate member 84 is formed of a dielectric material as above described, and substrate 84 and the metal conductors and the metal sheet(s) are of a thickness as above described.

A 50 ohm input/output port 90 is provided for antenna 80 in the manner that was described above relative to input/output port 51 of FIG. 5.

A 920 MHz antenna port 91 and a 1795 MHz antenna port 92, each being respectively 0.116 and 0.090-inch wide, interconnect diplexer 83 and antennas 81 and 82, respectively.

In accordance with the invention, an embodiment of the invention similar to FIG. 8 can be provided wherein antenna 80 the two antenna ports 91 and 92 terminate at a physical edge of substrate member 84, thus facilitating the cable-connection of diplexer 83 to an external 920 MHz antenna element (not shown) and to an external 1795 MHz antenna element (not shown).

In the manner above described, and in accordance with this invention, (1) when only a low MHz frequency (i.e., 920 MHz) is present, a matched (50 ohm) characteristic impedance path is provided between input/output port 90 and antenna port 91, as a mismatched impedance path (far from 50 ohms) is concomitantly provided between input/output port 90 and antenna port 92, (2) when only a high MHz frequency (i.e., 1795 MHz) is present, a matched (50 ohm) characteristic impedance path is provided between input/output port 90 and antenna port 92, as a mismatched impedance path (far from 50 ohms) is concomitantly provided between input/output port 90 and antenna port 91, and (3) when both the low MHz frequency and the high MHz frequency are present, a low impedance path is provided between input/output port 90 and antenna port 91 for only the low MHz frequency as a low impedance path is concomitantly provided between input/output port 90 and antenna port 92 for only the high MHz frequency.

The following Table 5 lists the various microstrip conductor elements that make up microstrip diplexer 83, along with their length in inches, their width in inches, and their characteristic impedance in ohms. Conductor length is measured parallel to the top surface 85 of substrate 84 and along the longest dimension of the particular conductor, and conductor width is measured parallel to the top surface 85 of substrate 84 and along the shortest dimension of the particular conductor.

TABLE 5

| | Impedance | Length | Width |
|---|---|---|---|
| Microstrip conductor 100 | 63.40 ohms | 0.809 inch | 0.077 inch |
| Microstrip conductor 101 | 63.40 ohms | 1.2424 inch | 0.077 inch |
| Microstrip conductor 102 | 63.40 ohms | 0.809 inch | 0.077 inch |
| Microstrip conductor 103 | 58.33 ohms | 2.775 inch | 0.089 inch |
| Microstrip conductor 104 | 45.39 ohms | 1.575 inch | 0.135 inch |
| Microstrip conductor 105 | 63.40 ohms | 1.363 inch | 0.214 inch |
| Microstrip conductor 106 | 84.37 ohms | 0.971 inch | 0.042 inch |
| Microstrip conductor 107 | 37.86 ohms | 1.200 inch | 0.178 inch |
| Microstrip conductor 108 | 52.03 ohms | 1.264 inch | 0.109 inch |

Dimension 110 of 1795 MHz antenna element 82 was 1.106-inch, dimension 111 was 1.110-inch, and dimension 112 was 0.129-inch.

Dimension 120 of 920 MHz antenna element 81 was 1.907-inch, dimension 121 was 1.840-inch, and dimension 112 was 0.199-inch.

Stub or dead-end conductor elements 105 and 108 join their respective conductor elements 104 and 107 at about the midpoints of conductors 104 and 108.

As shown in FIG. 8, whenever one conductor joins another conductor to form two series connected conductors, the two joining conductors are width-centered. For example, as conductor 106 joins conductor 104 on one end and conductor 107 on the other end, the longitudinal centers of all three joining conductors 104, 106, 107 lie on a common line.

The invention has been described while making reference to embodiments thereof wherein a microstrip/stripline diplexer/multiplexer network is comprised of a plurality of individual microstrip transmission line elements, each transmission line element having a specified characteristic impedance, a specified width and a specified length, it being noted that the stated characteristic impedances comprise real numbers at the high MHz operating frequencies of a diplexing/multiplexing antenna in accordance with the invention.

However, the spirit and scope of the invention is not to be limited to these detailed constructions and arrangements.

Within the spirit and scope of this invention, a microstrip or stripline multiplexing network can be provided wherein the multiplexer has one input port and N output ports (N being an integer that is greater than 2), wherein N antenna elements are provided with one antenna element being connected to each of the output ports. All that is required is that the individual microstrip/stripline elements that make up the microstrip/stripline multiplexer/diplexer network operate in combination to (1) provide impedance matching (for example, 50 ohm) between an input port and a given antenna element that is constructed and arranged to operate at a given high frequency when that given high frequency is present, and (2) to concomitantly provide that the one or more other antenna elements that are each constructed and arranged to operate at different high frequencies are effectively isolated from the input port and from this given high frequency due to a very mismatched impedance that is presented thereto by the microstrip/stripline multiplexer/diplexer network.

In this way, a microstrip/stripline multiplexer/diplexer network in accordance with the invention operates to automatically route a given high input frequency to only the antenna element that is constructed and arranged to be matched to or to operate at that given high input frequency.

FIG. 7 provides a more general teaching of the present invention, this figure being representative of the above-described FIG. 1 linear embodiment of the invention, and the above-described FIG. 5 bent embodiment of the invention.

In FIG. 7, it is shown that lower/higher MHz input 40 enters diplexer network 35 by way of a microstrip transmission line element that extends perpendicular to the longitudinal center of a composite transmission line element 48, 46 having a width that is designated as W2, and a length that is designated as L2.

When input 40 comprises the higher KHz input (e.g., 1920 MHz), this higher frequency input is automatically applied in a matched impedance manner to a higher frequency output 41 by way of (1) the longitudinal center of composite transmission line element 46,48 having the width W2 and length L2, and the longitudinal center of the composite transmission line element 47, 52 having a width W1 and length L1.

Similarly, when input 40 comprises the lower frequency input (e.g., 860 MHz), this lower frequency input is automatically applied in a matched impedance manner to a lower frequency output 42 by way of (1) the longitudinal center of composite transmission line element 46, 48 having a width W2 and length L2, and (2) the longitudinal center of composite transmission line element 49, 50 having a width W3 and a length L3.

Dimensions L1, W1, L2, W2, L3 and W3 are chosen such that the above-described matched impedance paths are established at the higher frequency only to higher frequency output port 41, while simultaneously allowing that a matched impedance path to be established at the lower frequency only to lower frequency output port 42.

As a result of the invention, when the antennas that are connected to output ports 41, 42 have limited bandwidth, as is the usual practice, the diplexer of the invention effectively isolates higher frequency output port 42 from input port 40 when a low frequency is applied to input 40, and conversely lower frequency output port 42 is isolated from input 40 when a high frequency is applied to input 40.

This operation results in the property that the two antennas that are connected to the respective two output ports 41, 42 exhibit little or no mutual coupling. Stated in terms of a transmission line, when low frequencies are applied to input 40, the insertion loss from input 40 to higher frequency output 41 is very high whereas the insertion loss from input 40 to lower frequency output 42 is very low, and conversely when high frequencies are applied to input 40, the insertion loss from input 40 to lower frequency output 42 is very high whereas the insertion loss from input 40 to higher frequency output 41 is very low.

In order to achieve a desired level of impedance matching and isolation, it may be necessary to add additional transmission line elements that are dead end or stub elements, as shown in FIG. 7 by elements 51 and 53. It is within the spirit and scope of this invention that such stub elements may be added at a junction between the above-described transmission line elements, or at an end of the above-described transmission line elements. The length and width of such added elements is chosen to achieve a desired level of impedance match and isolation at desired frequencies.

In an embodiment of the invention, a computer optimized program was used to find the best lengths and impedances of the entire diplexer network simultaneously due to the fact that every element in the network is coupled together with all other elements in the network, and it thus become impractical to individually find the best solution for each individual element. It is, however, within the spirit and scope of the invention to use other techniques as may be known to those skilled in the art once this invention is made known to them.

The spirit and scope of the invention includes other physical configurations of transmission line elements to produce this automatic frequency routing effect as will be apparent to those of skill in the art.

It is to be noted that in both the above-described linear embodiment of FIG. 1 and the above-described bent embodiment of FIG. 5, two four-way junctions 74 and 76 are respectively formed where output microstrip element 42 and output microstrip element 41 respectively join composite transmission line element 49, 50 and composite transmission line element 47, 52.

In visualizing the operation of the present invention, when a high MHz frequency input (i.e., 1920 MHz) is applied to input microstrip element 40, diplexer network 35 operates to generate an effectively matched impedance at junction 75 (for example, 50 ohms), whereas diplexer network 35 concomitantly operates to generate a mismatched impedance at junction 74 that is far from 50 ohms so as to effectively disconnect input 40 from low MHz frequency output 42.

However, when a low MHz frequency input (860 MHz) is applied to input microstrip element 40, diplexer network 35 operates to generate an effectively matched impedance at junction 74 (for example, 50 ohms), whereas diplexer network 35 concomitantly operates to generate a mismatched impedance at junction 75 that is far from 50 ohms so as to effectively disconnect input 40 from high MHz frequency output 41.

When comparing FIG. 1 to FIG. 5, it is noted that a four-way junction 76 is provided in the FIG. 1 embodiment relative to input microstrip element 40 whereas in the FIG. 5 embodiment, a corresponding three-way junction 77 is provided, three-way junction 77 becoming a four-way junction when edge connector 66 is used in the FIG. 5 embodiment.

It is noted that FIG. 5 two turns or bends 60 and 61 are achieved without the use of tuning stubs such as 44 and 45. Without limitation thereto, these two turns are best achieved when turn 60 is not located closely adjacent to the point at which transmission line element 46 joins transmission line element 47 (this point being best seen in FIG. 4), and when turn 61 is not located closely adjacent to the point at which transmission line element 48 joins transmission line element 49. These considerations also apply to the FIG. 8 embodiment.

Figure 9:
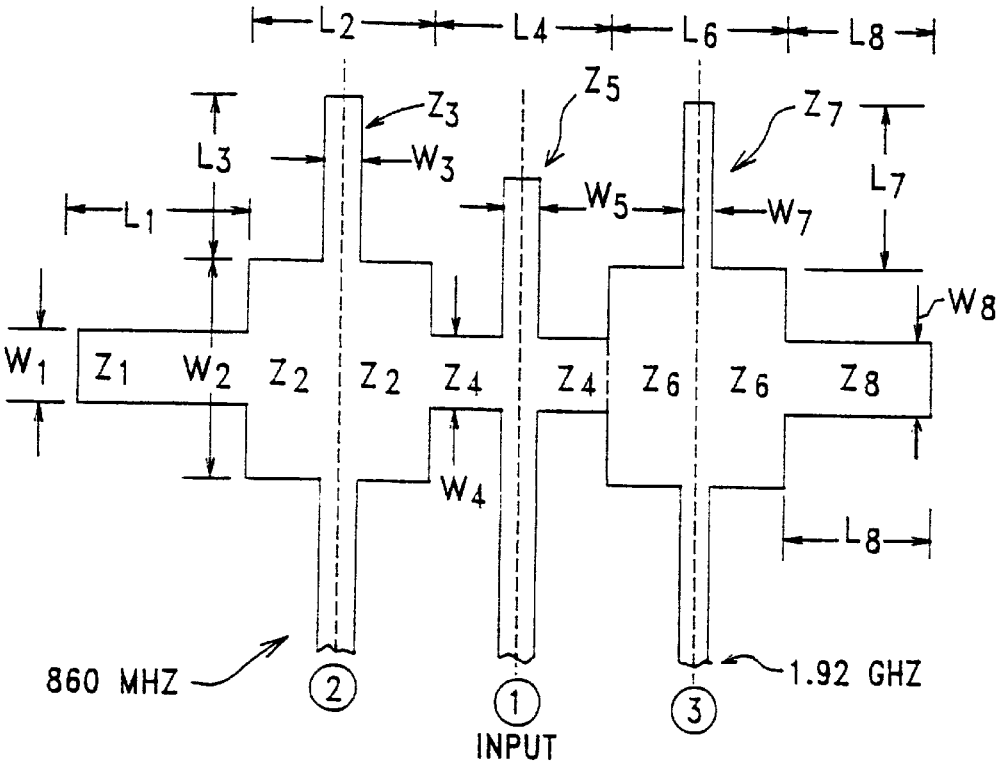

FIG. 9 shows a conceptual visualization of an antenna in accordance with the invention, FIG. 9 being representative of FIG. 1. In FIG. 9, the antenna 50 ohm input/output port is designated by the legend "INPUT", the 50 ohm port to which the 860 MHz antenna is connected is designated by the legend "860 MHz", and the 50 ohm port to which the 1920 MHz antenna is connected is designated by the legend "1.92 GHz". In FIG. 9, the various conductor elements are assigned the widths W1–W8 and their associated lengths L1–L8 and impedances Z1–Z8.

Figure 10:
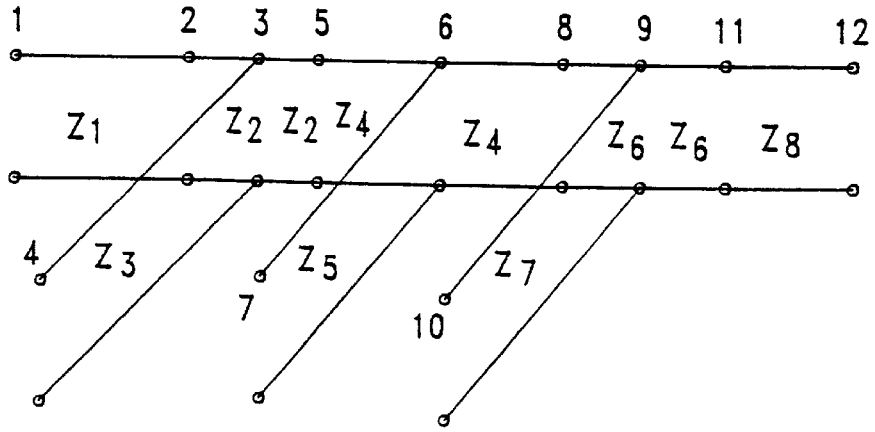

FIG. 10 relates to FIG. 9 in that numerals 1–12 of FIG. 10 trace conductor paths and their associated impedance values Z1–Z8 as shown in FIG. 9.

FIG. 11 provides a program listing that places constraints on the optimization program, as the optimization program seeks to define the physical construction that are shown in FIG. 9. For example, line 10 of the FIG. 11 program listing constrains the impedance parameter Z1 of FIG. 9 to be within the range 10 to 85 ohms, and line 19 of the FIG. 11 program listing constrains the associated length parameter L1 of FIG. 9 to be within the range 0.25 to 1.5-inch.

The intermediate term "14.3825" of FIG. 11 program listing line 10 is the ohmic value of Z1 that was determined by the optimization program, and the intermediate term "0.81879 in" in program listing line 19 is the length in inches of L1 that was determined by the optimization program.

FIG. 12 lists the values of Z1–Z8 and L1–L8 of FIG. 9 that were determined by the optimization program to thereby define the construction and arrangement of FIG. 9 in accordance with the invention, it being noted that the three lengths L2, L4 and L6 must be doubled since the related impedance areas Z2, Z4 and Z6 of FIG. 9 are each evenly divided by a stub conductor that is arranged to be coextensive with a port conductor.

FIG. 13 lists the values of L1–L8 and the corresponding values W1–W8 of FIG. 9 wherein dielectric constant effects, end effects, and physical discontinuity effects are taken into consideration to thereby provide in FIG. 12 the final vales for the FIG. 9 physical parameters L1–L8 and W1–W8.

Figure 14:
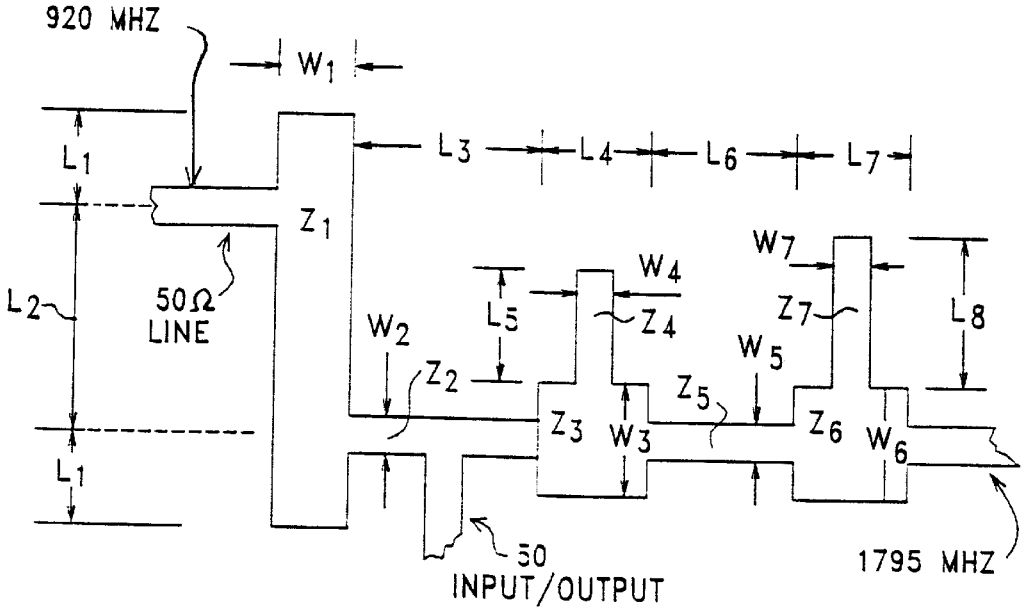

FIG. 14 shows a conceptual visualization of an antenna in accordance with the invention, FIG. 14 being representative of a linear version of FIG. 8. In FIG. 9, the antenna 50 ohm input/output port is designated by the legend "INPUT/OUTPUT", the 50 ohm port to which the 920 MHz antenna is connected is designated by the legend "920 MHz", and the 50 ohm port to which the 1795 MHz antenna is connected is designated by the legend "1795 MHz." In FIG. 9, the various conductor elements are assigned the widths W1–W8 and their associated lengths L1–L8 and impedances Z1–Z8.

Figure 15:
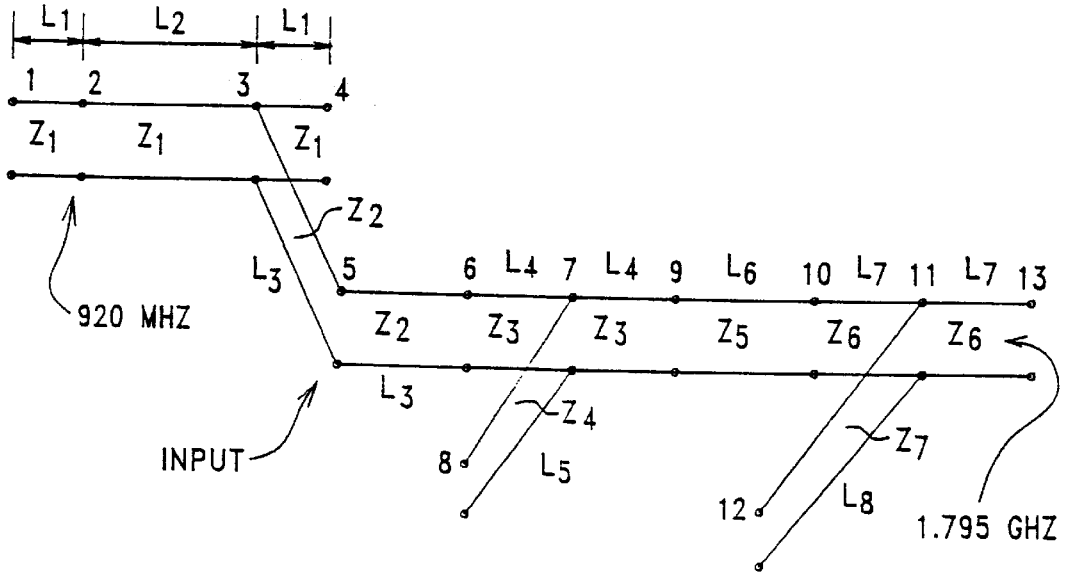

FIG. 15 relates to FIG. 14 in that numerals 1–13 of FIG. 15 trace conductor paths and their associated impedance values as shown in FIG. 14.

FIG. 16 provides a program listing that places constraints on the optimization program, as the optimization program seeks to define the physical construction that are shown in FIG. 14. For example, line 10 of the FIG. 16 program listing constrains the impedance parameter Z1 of FIG. 14 to be within the range 10 to 85 ohms, and line 18 of the FIG. 16 program listing constrains the length parameter L1 of FIG. 14 to be within the range 0.25 to 1.5-inch.

FIG. 17 provides the final values of Z, W and L for the FIG. 14 construction and arrangement.

The invention has been above described while making detailed reference to embodiments thereof However, since it is known that others skilled in the art will, upon learning of the invention, readily visualize yet other embodiments that are within the spirit and scope of the invention, the above detailed description is not to be taken as a limitation on the spirit and scope of the invention.

What is claimed is:

1. A multiplexing antenna operable at each one of N different frequencies, wherein N is an integer greater than 1, said antenna comprising:

an input port for transmitting/receiving energy at one or more of said N frequencies;

N output ports, said output ports being physically spaced from each other and from said input port;

N antenna elements, each one of said antenna elements being connected to a different one of said N output ports, and each one of said antenna elements being operable at a different one of said N frequencies;

a transmission line multiplexer network selected from the group microstrip transmission line, multiplexer network and stripline transmission line multiplexer network interconnecting said input port and said N output ports;

said transmission line multiplexer network having a plurality of interconnected transmission line elements whose individual characteristic impedance and individual length are selected to provide a matched-impedance path between a given one of said antenna elements and said input port when a corresponding one of said N frequencies for which said given one of said antenna elements is applied to said input port; and said transmission line multiplexer network concomitantly providing a mismatched-impedance path between all others of said antenna elements and said input port when said corresponding one of said N frequencies is applied to said input port.

2. The antenna of claim 1 wherein said transmission line multiplexer network includes N series-connected metallic transmission line elements that directly connect said input port to each of said N output ports, and at least one metallic transmission line element extending as a dead-end stub from each of said N series-connected metallic transmission line elements.

3. The antenna of claim 1 including:

a first flat dielectric substrate member having a first side that carries a metallic transmission line multiplexer network on a first portion of said first side, and that carries said antenna elements on a second portion of said first side; and a first metallic sheet element on an opposite side of said substrate member so as to underlie only said metallic transmission line multiplexer network.

4. The antenna of claim 3 including:

a second flat dielectric substrate member having a first generally flat side that carries a second metallic sheet element on one side thereof;

an opposite side of said second substrate member being in physical engagement with said metallic transmission line multiplexer network in a manner to cause said second metallic sheet element to overly only said metallic transmission line multiplexer network.

5. A method of providing a diplexing antenna that is operable at two different frequencies, comprising the steps of:

providing an input port for selectively receiving energy at one or both of said two frequencies;

providing two output ports that are physically spaced each other and from said input port;

providing two antenna elements that are individually operable at one of said two frequencies;

providing a transmission line diplexer that is selected from the group stripline diplexer and microstrip diplexer connecting said input port to each of said two output ports;

said transmission line diplexer providing a matched impedance path to a first of said two antenna elements when a first frequency is applied to said input port, and said transmission line diplexer concomitantly providing a mismatched impedance path to a second of said two antenna elements.

6. The method of claim 5 including the steps of:

providing said transmission line diplexer as first transmission line portions that directly connect said input port to each of said two output ports; and providing at least one second transmission line portion that extends as a stub from said first transmission-line portions.

7. A transmit/receive assembly operable to transmit or receive at one or more of a plurality N of different frequencies, comprising:

one input/output port;

a plurality N of antenna ports;

a planar transmission line diplexer/multiplexer selected from the group microstrip diplexer/multiplexer and stripline diplexer/multiplexer connecting said input/output port to each of said plurality of antenna ports;

each of said N antenna ports for transmitting/receiving a unique matching frequency that corresponds to a unique one of said N different frequencies;

said transmission line diplexer/multiplexer including a plurality of microstrip/stripline elements having physical dimensions selected such that said transmission line diplexer/multiplexer provides a matched impedance path between a given antenna port and said input/output port when a matching frequency corresponding to said given antenna port is received by said given antenna port, or when a matching frequency corresponding to said given antenna port is applied to said input/output port; and said transmission line diplexer/multiplexer concomitantly providing a mismatched impedance path between all others of said antenna ports and said input/output port.

8. The assembly of claim 7 wherein said plurality N of different frequencies is in the MHz or GHz range.

9. The assembly of claim 8 including:

a plurality N of antenna elements;

each of said antenna elements individually connected to a different one of said plurality N of antenna ports; and each of said antenna elements for receiving/transmitting a unique one of said N different frequencies.

10. An antenna operable at any or all of N different frequencies, comprising:

an input port for transmitting/receiving any or all of said N different frequencies;

N output ports, each of said output ports for operation at a different one of said N different frequencies;

a transmission line network interconnecting said input port and said N output ports;

said transmission line network having a plurality of interconnected transmission line elements whose individual physical dimensions are selected to provide a matched impedance path between a given output port and said input port when one of said N different frequencies for which said given output port is operable applied to said input port; and said transmission line network concomitantly providing a mismatched impedance path between all others of said output ports and said input port when said one of said frequencies for which said given output port is operable is applied to said input port.

11. The antenna of claim 10 wherein said transmission line network includes a plurality N of series connected metallic transmission line elements that individually connect said input port individual ones of said N output ports, and at least one metallic transmission line element extending as a dead-end stub at least one of said N series-connected metallic transmission line elements.

12. A method of providing an antenna that is operable at N different frequencies, comprising the steps of:

providing an input port for selectively receiving energy at said N different frequencies;

providing N output ports;

providing N antenna elements, each antenna element being operable at a different one of said N different frequencies;

connecting one of said N antenna elements to each of said N output ports to thereby define each output port as an output port that is operable at a corresponding one of said N different frequencies;

providing a transmission line network connecting said input port to each of said N output ports;

said transmission line network providing a matched impedance path to one of said N output ports when a frequency is applied to said input port corresponding to said one output port; and said transmission line network concomitantly providing a mismatched impedance path to all others of said output ports.

13. The method of claim 12 including the steps of:

providing said transmission line network as N transmission line portions that connect said input port to each of said N output ports; and providing at least one transmission line portion that extends as a stub from at least one of said N transmission line portions.

* * * * *